US008714403B2

(12) United States Patent
Amprimo

(10) Patent No.: US 8,714,403 B2
(45) Date of Patent: May 6, 2014

(54) NON SKID CONTAINER

(75) Inventor: Christophe Amprimo, Mehun sur Yevre (FR)

(73) Assignee: Pillivuyt, Mehun sur Yevre (FR)

( * ) Notice: Subject to any disclaimer, the term of this patent is extended or adjusted under 35 U.S.C. 154(b) by 0 days.

(21) Appl. No.: 13/695,441

(22) PCT Filed: Apr. 27, 2011

(86) PCT No.: PCT/FR2011/000258

§ 371 (c)(1),
(2), (4) Date: Oct. 31, 2012

(87) PCT Pub. No.: WO2011/135207

PCT Pub. Date: Nov. 3, 2011

(65) Prior Publication Data

US 2013/0043257 A1 Feb. 21, 2013

(30) Foreign Application Priority Data

Apr. 29, 2010 (FR) ..... 10 53325

(51) Int. Cl.
*B65D 25/24* (2006.01)
*B05D 5/00* (2006.01)

(52) U.S. Cl.
USPC ..... 220/628; 220/632; 220/636; 220/729; 427/287

(58) Field of Classification Search
USPC ..... 220/628, 632, 633, 634, 636, 729; 427/287
See application file for complete search history.

(56) References Cited

U.S. PATENT DOCUMENTS

| | | | | |
|---|---|---|---|---|
| 2,548,035 | A | 4/1951 | May | |
| 2,750,769 | A | 6/1956 | Yost et al. | |
| 3,490,583 | A * | 1/1970 | Cook | 206/386 |
| 6,520,369 | B1 * | 2/2003 | Cytacki | 220/632 |
| 2006/0179743 | A1 * | 8/2006 | Kishbaugh et al. | 52/235 |
| 2008/0105694 | A1 * | 5/2008 | Chen | 220/694 |

FOREIGN PATENT DOCUMENTS

| | | | | |
|---|---|---|---|---|
| EP | 451033 | A1 * | 10/1991 | A47J 36/02 |
| FR | 417 609 | | 11/1910 | |
| FR | 2 933 596 | | 1/2010 | |

OTHER PUBLICATIONS

International Search Report dated Jul. 5, 2011, corresponding to PCT/FR2011/000258.

* cited by examiner

*Primary Examiner* — Fenn Mathew
*Assistant Examiner* — Madison L Poos
(74) *Attorney, Agent, or Firm* — Young & Thompson

(57) ABSTRACT

A method for manufacturing an antiskid container (30) from a container (20) made of a ceramic or glass material, including a bottom wall (21) intended to be in contact with a flat support, the bottom wall including at least one antiskid pattern (28), the pattern including two grooves (25) delimiting at least one projection (24), the method including the following steps:

an antiskid material (34) in a fluid state is applied onto the antiskid pattern (28) so as to cover the projection at least partially, the antiskid material is caused to solidify so as to form an antiskid coating (31).

20 Claims, 3 Drawing Sheets

NON SKID CONTAINER

FIELD OF THE INVENTION

The present invention relates to an non-skid container. The field of the invention is that of ceramic products and glass products provided with an antiskid system.

The object of the invention is to provide a hollow or flat product made of a ceramic or glass material whose bottom is intended to be in contact with a flat surface, such as a dinner plate. This bottom is covered with an antiskid coating.

The invention also refers to a method for depositing the antiskid coating onto the ceramic or glass article.

STATE OF THE ART

In the catering field, some dishes are usually served in hollow containers such as ramekins, pots or cups placed on dinner plates. However, the traditional ceramic pots or ramekins have a smooth bottom skidding very easily when placed on an enameled dinner plate. There is then a high fall risk for the container.

To avoid this fall risk, it is known to provide the bottom of the container with a recessed or raised shape, the dinner plate having a complementary shape fitting together with that of the container. The container cannot then skid when in contact with the dinner plate. However, the position of the container on the dinner plate is fixed and cannot be modified, which is constraining for the user.

A solution is known in the state of the art to fix an antiskid material onto a glass object. This solution, illustrated in FIG. 1, consists in putting a silicone cord 16 on the bearing basis of the object 15. The cord is deposited in the form of a fluid elastomer composition, which is then caused to solidify by polymerization. The polymerization, more specifically vulcanization, allows for silicone to adhere to glass.

This cord is intended to provide the object 15 with a skid resistance so that said object can be placed onto a dinner plate and the unit object/dinner plate can be moved while minimizing the skid risks.

This cord 16 is not unobtrusive and has a big thickness, superior to approximately 1 mm compared to the surface of the glass. It has a detrimental effect on the visual aspect and on the attraction for using such objects.

This silicone cord 16 can be put on a ceramic object. Unfortunately, one then observes a problem of loss of cohesion, or separation, represented in FIG. 2.

Indeed, the edge of the silicone cord is delimited by two lips 17. There is a very high risk of loss of cohesion, or peeling, of the cord 16 via one of the lips 17. Indeed, the enamel of the base or bottom of an enameled ceramic article must be removed before cooking, otherwise the article will irremediably adhere to its cooking support. However, the crock of a ceramic article, obtained by sintering solid particles, has always some microroughness and a surface microporosity. These surface properties lead to a worse adherence of the silicone resins onto a non-enameled ceramic piece than onto a glass or enameled ceramic piece.

It is known, in particular from document FR2933596, to protect the lips of a silicone seal by inserting it into a groove in the bottom of the container.

However, in this invention, the silicone seal is inserted in a solid form, which does not guarantee its adherence to the walls of the groove. It is thus preferable to use an antiskid coating deposited in a fluid form into the groove and caused to solidify in situ.

However, the Applicant noted that such a method is difficult to implement. Indeed, it requires to determine precisely the quantity of coating needed for filling the groove volume. Too small a quantity would form a coating which would cover only the bottom of the groove and could not come into contact with the container support. Too big a quantity would cause the groove to overflow and would thus form peeling lips which would weaken the coating.

Consequently, there is today a need to find an economical, reliable and simple means allowing to deposit a strongly adherent antiskid coating onto a bottom of an article, in particular a ceramic article.

DISCLOSURE OF THE INVENTION

The purpose of the invention is to meet this need while finding a remedy for the disadvantages of the above-mentioned techniques. To this end, the invention proposes a ceramic or glass container whose bottom has such a geometrical shape that an antiskid material can be deposited thereon, this material allowing a strong adherence to a flat support such as a dinner plate. The invention also refers to a method for manufacturing such a container.

More precisely, the object of the invention is a method for manufacturing an antiskid container from a ceramic or glass container comprising a bottom wall intended to be in contact with a flat support, said bottom wall comprising at least one antiskid pattern, said pattern including two grooves delimiting at least one projection, said method including the following steps:

- an antiskid material in a fluid state is applied onto the antiskid pattern so as to cover the projection at least partially, and possibly the grooves at least partially,
- the antiskid material is caused to solidify so as to form an antiskid coating.

The antiskid material covering the bottom of the container enables to prevent said container from skidding on the flat support.

The shape of the antiskid pattern gives a good solidity to the coating, which diminishes the risks of loss of cohesion. Indeed, the W shape of the formed coating allows a better resistance than the shape resulting from a single groove.

Preferentially, the dimensions of the pattern and the applied quantity of antiskid material are selected so that the peeling lips, formed by the edges of the coating, are located in the grooves. Consequently, according to the invention, the pattern is preferentially dimensioned so that the sides of the grooves are able to protect the coating from loss of cohesion and from mechanical and chemical stresses. The dimensions of said pattern enable to ensure a perfect stability of the container without having a detrimental effect on the visual aspect thereof.

In a preferential way, the antiskid material is deposited onto the projection and then flows by gravity into the grooves, a layer of material remaining on the projection.

In a preferential way, the antiskid material is an elastomeric silicone composition and said material is caused to solidify by heating. In this case, the material is caused to solidify in particular by vulcanization.

The object of the invention is also an antiskid container manufactured by a method such as described above. Preferentially, edges of the coating of said container form lips inside the grooves. The risk of loss of cohesion is thus strongly limited.

According to an embodiment of the invention, the grooves and the projection have a concentric or longitudinal shape.

According to another embodiment of the invention, the grooves and the projection are made along a serpentine path.

According to an embodiment of the invention, at least two antiskid patterns are distributed on the bottom wall.

According to an embodiment of the invention, the projection forms a raised element with respect to the bottom wall, so that only the projection is able to come into contact with a flat support of said container.

According to another embodiment of the invention, the projection is almost coplanar with the bottom wall. Thus, the projection and the bottom wall can both come into contact with the support.

According to an embodiment of the invention, the grooves present a widened section, in particular trapezoidal, hemispherical or triangular.

Advantageously, the container according to the invention is made of a ceramic, glass-ceramic or glass material.

BRIEF DESCRIPTION OF THE FIGURES

The invention will be better understood from the following description and the annexed Figures. These Figures are given only as an illustration, and by no means a restriction, of the invention.

DETAILED DESCRIPTION OF EMBODIMENTS OF THE INVENTION

In the description, the same numerical references indicate throughout the Figures identical or functionally similar elements.

Figure 1:
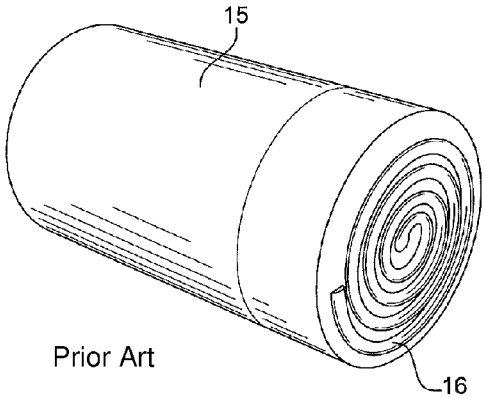
FIGS. 1 and 2, already described, show a schematic representation of a container of the state of the art, provided with an antiskid material.
Figure 2:
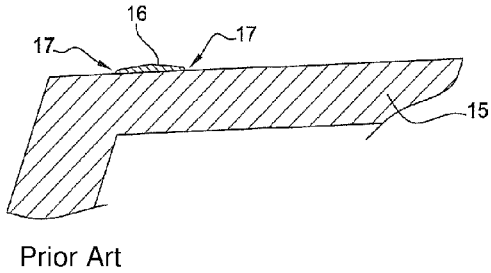
Figure 3:
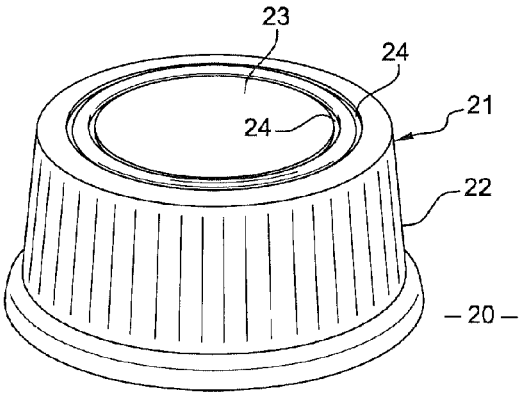
FIG. 3 shows a perspective view of a ceramic article for manufacturing a container according to an embodiment of the invention.

FIG. 3 schematically represents a perspective view of a container 20 for manufacturing an antiskid container according to an embodiment of the invention. In the following description, the terms "horizontal, vertical, height . . . " are to be understood by considering that the bottom of the container 20 is substantially arranged in a horizontal plane.

The container 20 can be a hollow utensil intended to contain a liquid, gas or solid substance. It can be also a dinner plate. This container 20 can have various shapes and dimensions. The container 20 can be made of porcelain, earthenware, glass-ceramic material, sandstone, terra cotta or any other types of ceramic material. The container 20 can also be made from glass. In the remainder of the description, it is considered that the container 20 is made of a ceramic material.

In the example in FIG. 3, the container 20 is a small utensil having a round or oval shape, with right edges 8 to 10 cm in diameter, such as a ramekin. In FIG. 3, it is presented upside down, with the bottom upwards.

The container 20 comprises a horizontal bottom wall 21, from the periphery of which a side wall 22 extends upwards. The bottom wall 21 can have various shapes of the rectangular or oval type. In the example in FIG. 3, the bottom wall 21 has a circular shape. The container 20 comprises a bearing surface 23 for the bottom wall 21 whereby said container is adapted to bear on a flat support, not represented, such as a dinner plate.

Figure 4:
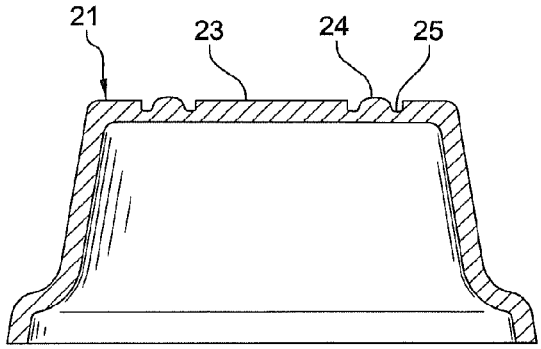
FIG. 4 shows a cross-section of the article in FIG. 3.

FIG. 4 represents a vertical cross-section of the container 20 in FIG. 3. The bottom wall 21 comprises at least one antiskid pattern 28. This antiskid pattern 28 is integrated in the manufacturing mold of the container 20. The pattern 28 is thus incorporated into the container 20 when manufacturing. This antiskid pattern 28 is designed so as to receive an antiskid material in order to form an antiskid coating on the container 20. The antiskid coating is not represented in FIG. 4.

In order to provide the antiskid coating with a good adherence and a high mechanical and chemical resistance, the pattern 28 comprises two notches or grooves 25, delimiting at least one projection 24 having a raised form. The grooves 25 are thus located on both sides of the projection 24, so that said projection is geometrically separated from the bearing surface 23 by said grooves. This pattern has the advantage of not being very sensitive to small dimensional variations from one piece to another obtained from the same mold.

As it will be developed further, this antiskid pattern, which is made in a very simple manner, enables to lower the precision required to determine its dimensions and the quantity of antiskid material deposited. It also enables to reduce the risks of peeling while allowing a good adherence.

In the example in FIG. 3, the bottom wall 21 comprises only one antiskid pattern, said pattern comprising a circular projection 24 delimited by two concentric grooves 25. The antiskid pattern of the example in FIG. 3 is made on all the circumference of the bottom wall 21 near the periphery. In this example, the pattern is made approximately three millimeters from the periphery so as to maximize the surface of the antiskid coating and to ensure a better stability of the container 20 on its support.

In an alternative embodiment, the path followed by the antiskid pattern 28 on the bottom wall 21 can have a serpentine shape, i.e. the path comprising one or more successive bends. This type of path is preferentially chosen so as to follow at best the contours of the bottom wall 21, when the shape of the latter is not circular but, for example, rectangular.

In the embodiment in FIG. 4, the projection 24 can be on the same level as the surface of the bottom wall 21. In other words, the projection 24 is almost coplanar with the surface 23. In this case, the container 20 bears on the flat support via the surface 23 and the antiskid coating covering the projection 24.

Figure 5:
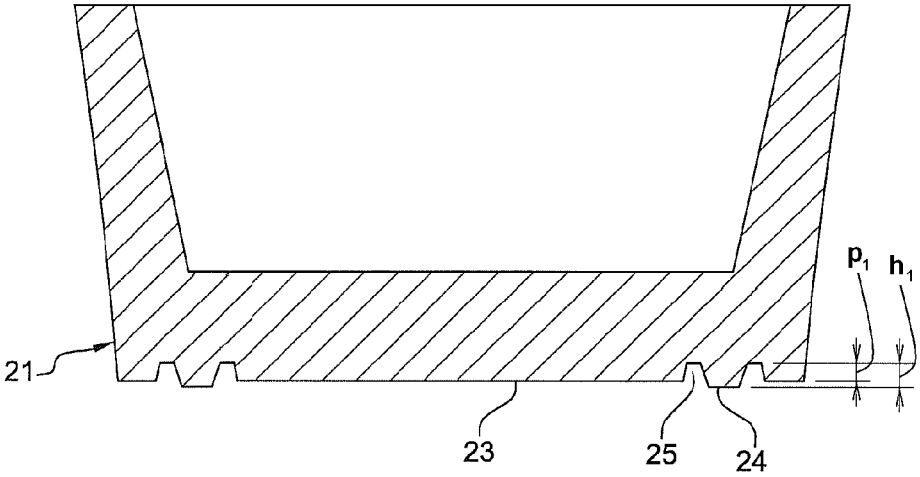

FIG. 5 represents a vertical cross-section of a container 20 according to another embodiment of the invention. In the vertical direction, the projection 24 has a height h1 superior to a depth p1 of the grooves 25. Thus, the projection 24 forms a raised element with respect to the surface 23. In this case, the container 20 bears on the flat support only via the projection 24 covered with the antiskid coating. The surface 23 does not then have a bearing function on the support of the bottom wall 21.

After several experiments, it appeared that a height of the projection 24 approximately 1 millimeter above the surface 23 (that is to say $h_1-p_1=1$ mm) allows for the container 20 to optimally adhere to the dinner plate and to be easily manufactured. The user will thus have the impression, when placing the container 20 onto the dinner plate, that it can adhere thereon automatically and be separated therefrom without effort.

In the example in FIG. 5, the height $h_1$ of the projection 24 is substantially equal to 2.5 millimeters and the depth $p_1$ of the grooves 25 is about 2 millimeters. The grooves 25 are preferentially made with a widened shape. In the example in FIG. 5, the grooves 25 have a trapezoidal section. In other embodiments, the grooves 25 can have a hemispherical or triangular section.

The dimension of the pattern 28 is preferentially determined so as to ensure a perfect stability of the container 20 without having a detrimental effect on the visual aspect thereof. This dimension depends in particular on the diameter of the bottom wall.

Figure 6:
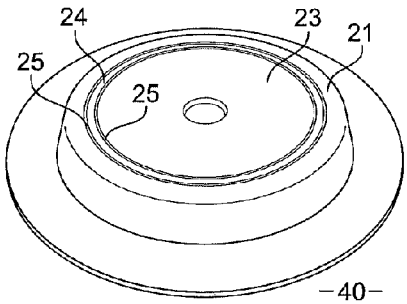
FIGS. 5, 6 and 7 show schematic cross-sections of ceramic articles for manufacturing a container according to other embodiments of the invention.

FIG. 6 shows a dinner-plate-shaped container 40 provided with the pattern 28 according to the invention. In this example, the bottom wall 21 comprises only one antiskid pattern 28, made on all the circumference of the bottom wall 21 near the periphery, comprising a circular projection 24 delimited by two concentric grooves 25.

Figure 7:
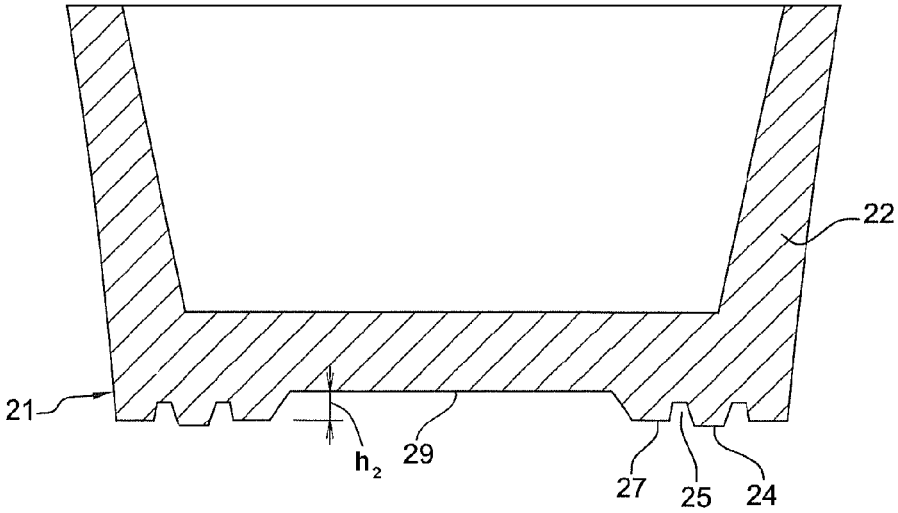

FIG. 7 shows a vertical cross-section of another embodiment of the bottom wall 21. In this example, the bearing surface of the container 20 comprises a base 27 delimiting a hollow surface 29. In an example, the base 27 has a height $h_2$ of 3 mm compared to the surface 29. The base 27 separates the antiskid pattern 28 from the hollow surface. Thus, starting from the periphery of the bottom wall 21, one finds a first groove 25, the projection 24, the second groove 25, the base 27 and the hollow surface 29.

Figure 8:
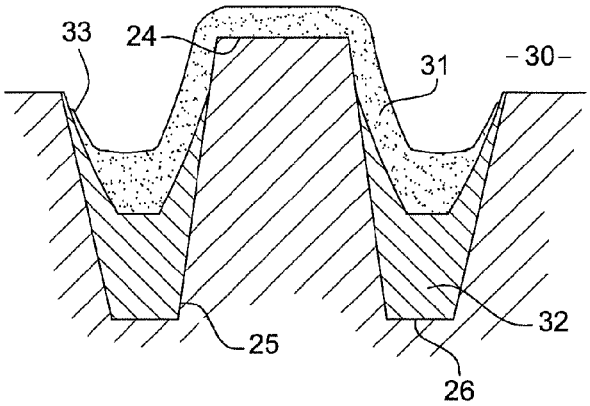
FIG. 8 shows a detailed sectional view of an antiskid container according to an embodiment of the invention.

FIG. 8 shows a detailed vertical cross-section of a container 30 according to an embodiment of the invention. Said container 30 is formed by the application of an antiskid material onto the pattern 28 of the container 20 in FIG. 5 or FIG. 7 in order to form an antiskid coating 31.

The containers 20 in FIGS. 5 and 7 are preferentially made of enameled ceramic material. The enamel of their bottom must thus be removed before cooking for not adhering to the support. To guarantee a good adherence of the antiskid coating, only the enamel of the projection 24 of the pattern 28 is removed and the sides of the interior face 26 of the grooves 25 remain enameled. The enamel 32 covering the sides of the grooves 25 presents the physical and chemical characteristics allowing an optimal adherence of the coating 31, which is preferentially formed by an elastomer of the silicone type.

Preferably, the pattern 28 and the quantity of fluid antiskid material applied onto said pattern are dimensioned so that the lips 33, forming the edges of the coating 31, are positioned inside the grooves 25. Moreover, the width of the grooves 25 is preferentially very small, about some mm. It is thus difficult for a user to come into contact with the lips 33.

In order to decrease the precision needed to deposit the antiskid material, this deposition is preferentially carried out by gravity, from a fluid composition.

In a preferred embodiment, the coating is a silicone composition, in particular a self-leveling one. The silicone used has a strong coefficient of friction and a high resiliency due to its elastomer properties, but also a very good thermal and chemical resistance.

In a preferred embodiment, the silicone composition has a white or translucent color in order to make the coating almost invisible to the naked eye.

The viscosity of the silicone composition can vary in a wide range, between 10 and 106 mPa·s at 23° C. Preferably, the viscosity is about 20.000 to 40.000 mPa·s.

Figure 9:
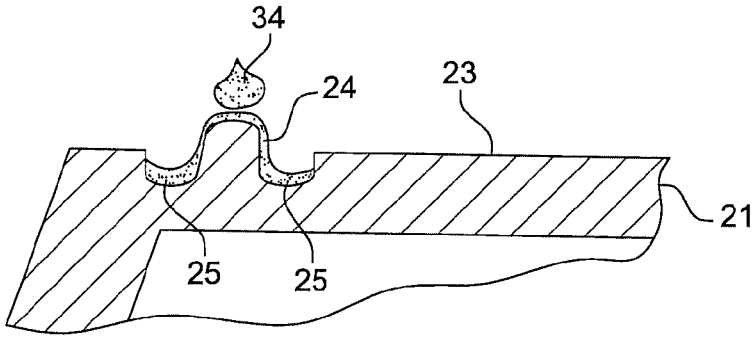
FIG. 9 shows a step of a method for manufacturing an antiskid container according to an embodiment of the invention.

FIG. 9 shows a method for depositing an antiskid material onto the pattern 28 of the container in FIG. 4. The container 20 is placed upside down so as to orientate the bottom 21 upwards, substantially horizontally. The antiskid material 34, in a fluid form, is preferentially applied onto the projection 24. The material then flows by gravity into the hollow grooves 25. When one uses a silicone resin having a sufficient viscosity, for example about 40.000 mPa·s at 23° C., the projection 24 remains covered with a fine layer of silicone after the end of the flowing process. The thickness of this layer can be about 0.5 mm. One can say thus that the silicone resin partially flows into the grooves before reticulation.

FIG. 8 (already described) shows the result obtained after the silicone resin is reticulated, for forming the coating 31. According to the cutting plane in FIG. 8, the coating 31 substantially has a W-shaped section. The lips 33 forming the edge of the coating 31, which constitute the weak point of the silicone deposition, are located inside the hollow grooves 25. This position gives them a certain protection against the mechanical and chemical stresses from the user.

Owing to the fact that the precision needed to deposit the silicone product is not very important, this deposition can be carried out according to several methods. Moreover, the projection 24 is preferentially configured so that it has an axial symmetry, perpendicular to the bottom of the ceramic article, so that its space positioning can be ensured without using an automatic positioning device.

In an embodiment, the deposition method is implemented manually. To this end, a piston syringe is filled with an antiskid fluid composition. The piston syringe can be filled with a premix of a silicone resin comprising two components or more, followed by a de-airing. Using this syringe, an operator deposits the composition onto the projection 24. The composition then flows naturally by gravity into the grooves 25.

In another embodiment, the deposition method is implemented by using an automat (not represented) provided with a deposition machine. This automat can also be provided with a system of proportioning and mixing the various components of the resin, which avoids working with a premix whose lifespan is limited before the beginning of polymerization.

When the deposition of the fluid composition is over, a step of accelerating the polymerization is started, for example by heating the bottom wall 21 at approximately 150° C. for 10 minutes.

The deposition can be localized or continuous according to the configuration of the bottom pattern 28 intended to receive the deposition.

FIGS. 10*a* to 10*e* show various embodiments of the bottom wall 21 into which at least two antiskid patterns 28 are integrated. In these embodiments, the pattern 28 is applied several times onto the bottom wall 21 so as to obtain clear zones, that is uncovered with the coating 31 at the places of the bearing surface 23. These distributed patterns 28 have dimensions of about a few millimeters. In a preferred embodiment, the patterns 28 are equidistant from each other. They can be randomly distributed on the bottom wall 21. Their number can also be arbitrarily selected.

Figure 10A:
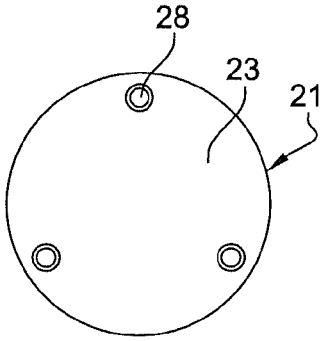
FIGS. 10*a* to 10*f* show a schematic view of the container bases according to several embodiments of the invention.

In the embodiment illustrated in FIG. 10*a*, three antiskid patterns 28 having a circular shape are made on the bottom wall 21. Each pattern comprises two circumferential grooves 25 delimiting the projection 24.

Figure 10B:
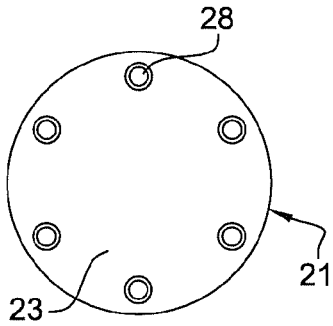

In the embodiment illustrated in FIG. 10*b*, six antiskid patterns 28 having a circular shape are made on the bottom wall 21. Each pattern comprises two circumferential grooves 25 delimiting the projection 24.

Figure 10C:
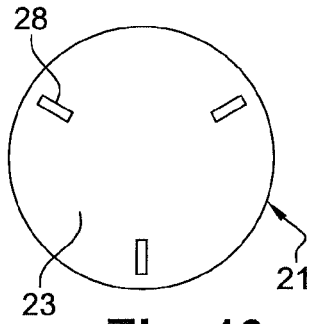

In the embodiment illustrated in FIG. 10*c*, three antiskid patterns having a longitudinal shape are made on the bottom wall 21. Each pattern comprises two grooves 25 delimiting the stick-shaped projection 24. This longitudinal shape of the antiskid pattern 28 enables to prevent the container 20 from rotatingly skidding on the flat support.

Figure 10D:
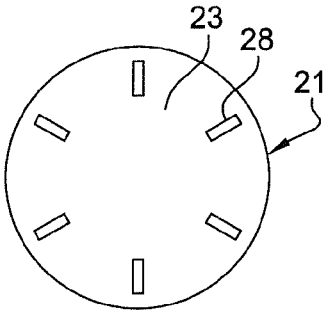

In the embodiment illustrated in FIG. 10*d*, six stick-shaped antiskid patterns are made on the bottom wall 21. Each pattern comprises two longitudinal grooves 25 delimiting the projection 24.

Figure 10E:
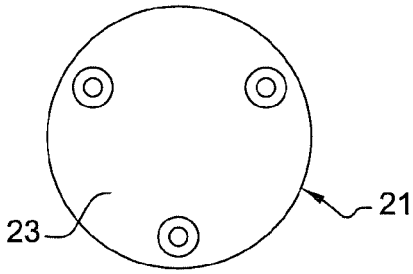
Figure 10F:
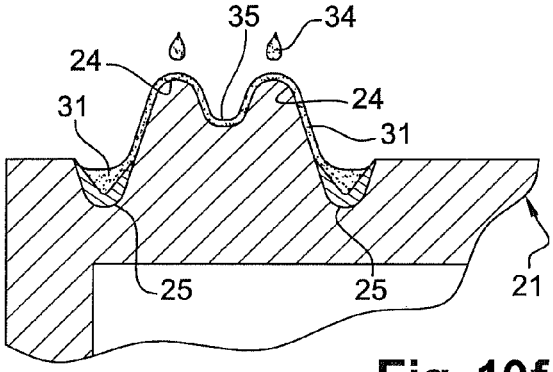

The embodiment illustrated in FIG. 10*e* enables to obtain a suction effect by generating a depression within the coating. A cross-section of this embodiment is illustrated in FIG. 10*f*. In this example, the antiskid pattern comprises two grooves 25 on both sides of the two projections 24. The two projections are separated by a pattern 35. The antiskid material 34 is deposited onto each projection 24. The cavity in the pattern 35 enables to implement the suction effect.

In the example in FIG. 10*e*, three antiskid patterns having a circular shape with a suction effect are made on the bottom wall 21. The larger the surface of the coating 31 in contact with the flat support is, the more a suction effect there is which will allow for the container 20 to adhere to the flat support.

The present invention is not limited to the above-described embodiments. In particular, the various embodiments illustrated in the Figures can be combined. One can also consider:

- a succession of concentric antiskid patterns,
- a single longitudinal antiskid pattern extending along the bottom wall,
- a succession of longitudinal antiskid patterns radially extending on the surface of the bottom wall.

The invention thus enables to obtain a container comprising on its bottom wall an almost invisible antiskid system, thanks to the transparency of the antiskid coating and to the particular profile of the pattern 28 onto which it is deposited.

The invention claimed is:

1. A method for manufacturing an antiskid container (30) from a container (20), said method including the following steps:

applying an antiskid material (34) in a fluid state onto an antiskid pattern (28) situated on a bottom wall (21) of the container (20), wherein the container (20) is made of a ceramic or glass material, said bottom wall (21) configured to be in contact with a flat support, said antiskid pattern including two grooves (25) located within a flat portion of the bottom wall (21) such that the flat portion of the bottom wall (21) is located at outside edge of each groove (25) and an inside edge of each groove delimits a projection (24) therebetween, and the antiskid material being applied so as to situated on a bottom wall (21) of the container (20), said bottom wall (21) being intended to be in contact with a flat support, the antiskid material being applied cover the projection; and, causing the antiskid material to solidify so as to form an antiskid coating (31).

2. The method according to claim 1, wherein the antiskid material is deposited onto the projection and then flows by gravity into the grooves, a layer of material remaining on the projection.

3. The method according to claim 1, wherein the antiskid material is an elastomeric silicone composition and the solidification of said material is carried out by heating.

4. An antiskid container manufactured by a method according to claim 1.

5. The container according to claim 4, wherein edges of the coating form lips (33) inside the grooves (25).

6. The container according to claim 4, wherein the grooves and the projection have a concentric or longitudinal shape.

7. The container according to claim 4, wherein at least three antiskid patterns are distributed on the bottom wall.

8. The container according to claim 4, wherein the projection forms a raised element with respect to the bottom wall so that only the projection is able to come into contact with a flat support of said container.

9. The container according to claim 4, wherein the projection is almost coplanar with the bottom wall.

10. The container according to claim 4, wherein the grooves have a widened section.

11. The method according to claim 2, wherein the antiskid material is an elastomeric silicone composition and the solidification of said material is carried out by heating.

12. The container according to claim 5, wherein the grooves and the projection have a concentric or longitudinal shape.

13. A method for manufacturing an antiskid container (30), comprising the steps of:

applying an antiskid material (34), in a fluid state, onto an antiskid pattern (28) situated on a bottom wall (21) of a container (20), wherein the container (20) is made of a ceramic material or a glass material, said bottom wall (21) comprises a flat bearing surface (23) to bear on a flat support, said antiskid pattern includes two grooves (25) located within the bearing surface of the bottom wall (21) such that a first flat portion of the bearing surface (23) is located at an outside edge of a first of the grooves (25), a second flat portion of the bearing surface (23) is located at an outside edge of a second of the grooves (25), and a projection (24) is delimited by inside edges of the first and second grooves (25), and the antiskid material is applied so as to situated on a bottom wall (21) of the container (20); and, causing the antiskid material to solidify so as to form an antiskid coating (31) covering the two grooves and the projection.

14. The method of claim 13, wherein, with the bottom wall (21) facing upward, a height of the first and second flat portions is lower than a height of a top of the projection (24), the projection is a circular projection (24), the first and second grooves are two concentric grooves (25) delimiting the circular projection (24), and the second flat portion of the bearing surface (23) located at the outside edge of the second groove (25) defines a circular flat portion of the bearing surface (23).

15. The method of claim 13, wherein, with the bottom wall (21) facing upward, a height of the first and second flat portions is at a same a height as a top of the projection (24), so that the projection (24) is almost coplanar with the first and second flat portions of the bearing surface (23) located at the outside edges of the first and second grooves (25).

16. The method of claim 14, wherein, the bottom wall (21) comprises plural of said first and second grooves and plural of said projections located between each said first and second grooves to thereby define plural antiskid patterns, and said antiskid patterns are arranged equidistant from each other on the bottom wall (21).

17. The method of claim 15, wherein, the bottom wall (21) comprises plural of said first and second grooves and plural of said projections located between each said first and second grooves to thereby define plural antiskid patterns, and said antiskid patterns are arranged equidistant from each other on the bottom wall (21).

18. The method of claim 13, wherein, the bottom wall (21) comprises plural of said first and second grooves and plural of said projections located between each said first and second grooves to thereby define plural stick-shaped projections (24), and said stick-shaped projections spaced apart in a radially outward projection direction.

19. The method of claim 13, wherein, said projection (24), delimited by the inside edges of the first and second grooves (25), includes a cavity pattern (35) that divides the projection (24) into two adjacent projecting elements (24), and the antiskid coating (31) covers the first and second grooves, the cavity pattern (35), and the two adjacent projecting elements (24).

20. The method of claim 13, wherein, prior to said applying an antiskid material (34) step, each of said grooves is covered by enamel (32), and a distal end of said projection (24) is free of the enamel.

* * * * *